US008641450B2

(12) United States Patent
Li

(10) Patent No.: US 8,641,450 B2
(45) Date of Patent: Feb. 4, 2014

(54) USB CONNECTOR AND CONNECTING DEVICE WITH USB CONNECTOR

(75) Inventor: Zhan-Yang Li, Shenzhen (CN)

(73) Assignees: Hong Fu Jin Precision Industry (ShenZhen) Co., Ltd, Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 62 days.

(21) Appl. No.: 13/462,887

(22) Filed: May 3, 2012

(65) Prior Publication Data

US 2013/0052867 A1 Feb. 28, 2013

(30) Foreign Application Priority Data

Aug. 25, 2011 (CN) ..... 2011 1 0246230

(51) Int. Cl.
*H01R 13/648* (2006.01)

(52) U.S. Cl.
USPC ..... 439/607.28; 439/540.1

(58) Field of Classification Search
USPC ..... 439/607.28, 607.53, 607.23, 607.24, 439/607.25, 607.27, 607.58, 540.1
See application file for complete search history.

(56) References Cited

U.S. PATENT DOCUMENTS

| | | | | |
|---|---|---|---|---|
| 7,641,514 | B2 * | 1/2010 | Chen et al. | 439/540.1 |
| 7,857,662 | B2 * | 12/2010 | Gillespie et al. | 439/607.3 |
| 7,922,534 | B2 * | 4/2011 | Lin et al. | 439/607.27 |
| 8,011,961 | B2 * | 9/2011 | Liu et al. | 439/607.58 |
| 8,118,615 | B2 * | 2/2012 | Peng et al. | 439/607.27 |
| 8,157,584 | B2 * | 4/2012 | Zhou et al. | 439/541.5 |
| 2009/0269977 | A1 * | 10/2009 | Chen et al. | 439/540.1 |
| 2010/0093219 | A1 * | 4/2010 | Liu et al. | 439/607.58 |
| 2011/0003506 | A1 * | 1/2011 | Zhou et al. | 439/540.1 |
| 2011/0143590 | A1 * | 6/2011 | Peng et al. | 439/607.23 |

* cited by examiner

*Primary Examiner* — Hae Moon Hyeon
(74) *Attorney, Agent, or Firm* — Altis Law Group, Inc.

(57) ABSTRACT

A connecting device includes a protecting member, a base, a USB connector, and a covering member. The USB connector is mounted in the base. The covering member is secured to the base and covers the base. The covering member and the base are received and mounted in the protecting member. The USB connector comprises a body for securing a USB cable and a shelter surrounding the body; the shelter comprises a plurality of blocking pieces, and each of the plurality of blocking pieces abuts the protecting member, to prevent EMI from the body.

19 Claims, 6 Drawing Sheets

USB CONNECTOR AND CONNECTING DEVICE WITH USB CONNECTOR

BACKGROUND

1. Technical Field

The present disclosure relates to a Universal Serial Bus (USB) connector and a connecting device using a USB connector.

2. Description of Related Art

A plurality of USB connectors is used in a computer or a server. The plurality of USB connectors are received in a bracket, and the bracket is secured to a metallic housing. A protecting member receives the metallic housing and includes a plurality pairs of blocking pieces for electromagnetic interference (EMI) protection. Each pair of the blocking pieces corresponds to each of the USB connector. A length of the protecting member may need to be adjustable according to a number of the plurality of USB connectors. Therefore, protecting members of different lengths may need to be individually designed. Therefore, an improved USB connector and a connecting device with a USB connector may be desired within the art.

BRIEF DESCRIPTION OF THE DRAWINGS

Many aspects of the embodiments can be better understood with reference to the drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
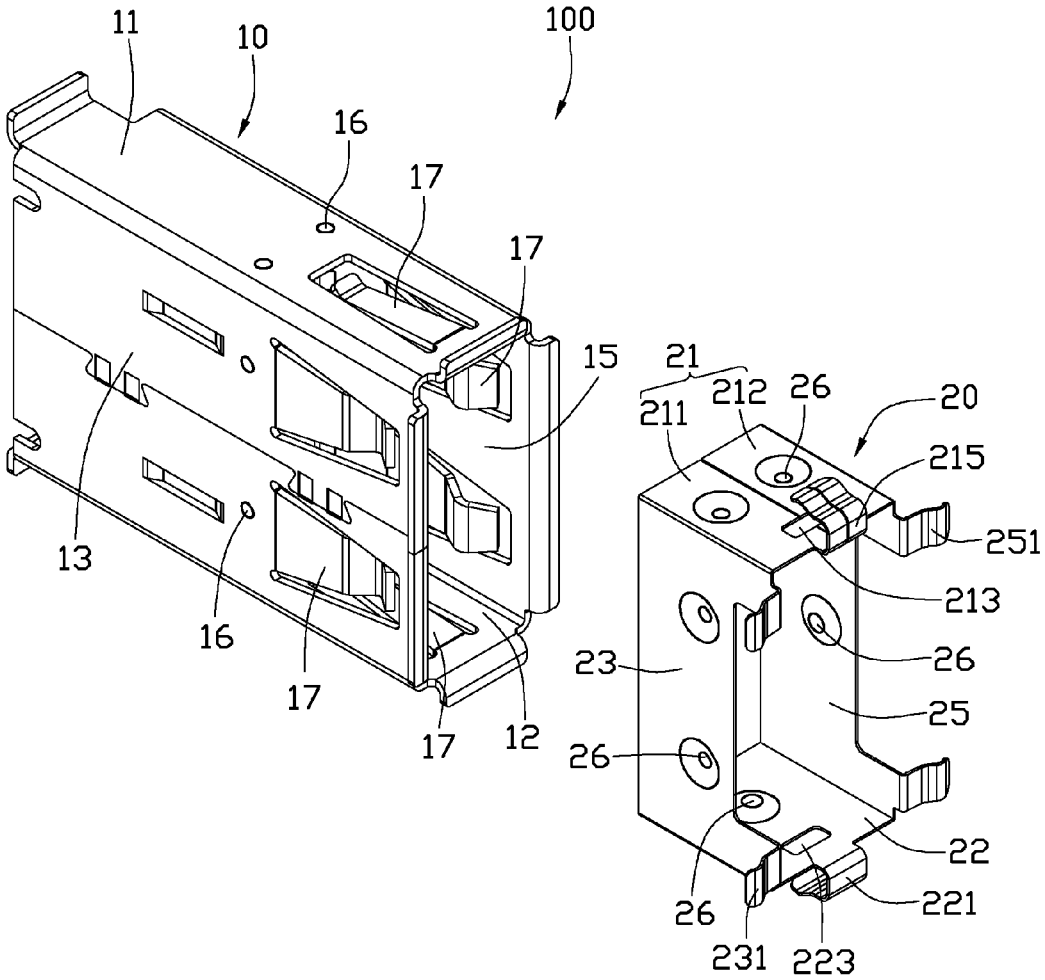
FIG. 1 is an exploded, isometric view of one embodiment of a USB connector.

FIG. 1 shows one of a plurality of USB connectors 100 in accordance with an embodiment including a body 10 and a shelter 20.

The body 10, adapted to secure a USB cable (not shown), includes a top panel 11, a bottom panel 12, a front panel 13, and a rear panel 15. In one embodiment, the top panel 11 is substantially parallel to the bottom panel 12, the front panel 13 is substantially parallel to the rear panel 15 and perpendicular to the top panel 11. Each of the top panel 11, the bottom panel 12, the front panel 13 and the rear panel 15 defines an installation hole 16. A resilient piece 17 obliquely extends inwards from each of the top panel 11, the bottom panel 12, the front panel 13 and the rear panel 15.

The shelter 20 includes a top plate 21, a bottom plate 22, a front plate 23, and a rear plate 25. In one embodiment, the top plate 21 is substantially parallel to the bottom plate 22, the front plate 23 is substantially parallel to the rear plate 25 and perpendicular to the top plate 21. The top plate 21 includes a first plate 211 and a second plate 212. The first plate 211 is substantially perpendicularly connected to the front plate 23. The second plate 212 is substantially perpendicularly connected to the rear plate 25. A gap (not labeled) is defined between the first plate 211 and the second plate 212. An extrusion 26 protrudes inwards from each of the first plate 211, the second plate 212, the bottom plate 22, the front plate 23, and the rear plate 25. The top wall 21 defines a first cutout 213. The first cutout 213 extends from the first plate 211 to the second plate 212 and communicates from the gap. The first cutout 213 receives the resilient piece 17 of the top panel 11 when the resilient piece 17 is elastically deformed downwards. A first blocking piece 215 extends from a side edge of each of the first plate 211 and the second plate 212. A second blocking piece 221 extends from a side edge of the bottom plate 22. The bottom plate 22 defines a second cutout 223. The second cutout 223 receives the resilient piece 17 of the bottom panel 12 when the resilient piece 17 is elastically deformed upwards. Two third blocking pieces 231 extend outwards from a side edge of the front plate 23. Two fourth blocking pieces 251 extend from rear plate 25. Each of the two third blocking pieces 231 corresponds to each of the two fourth blocking pieces 251.

Figure 2:
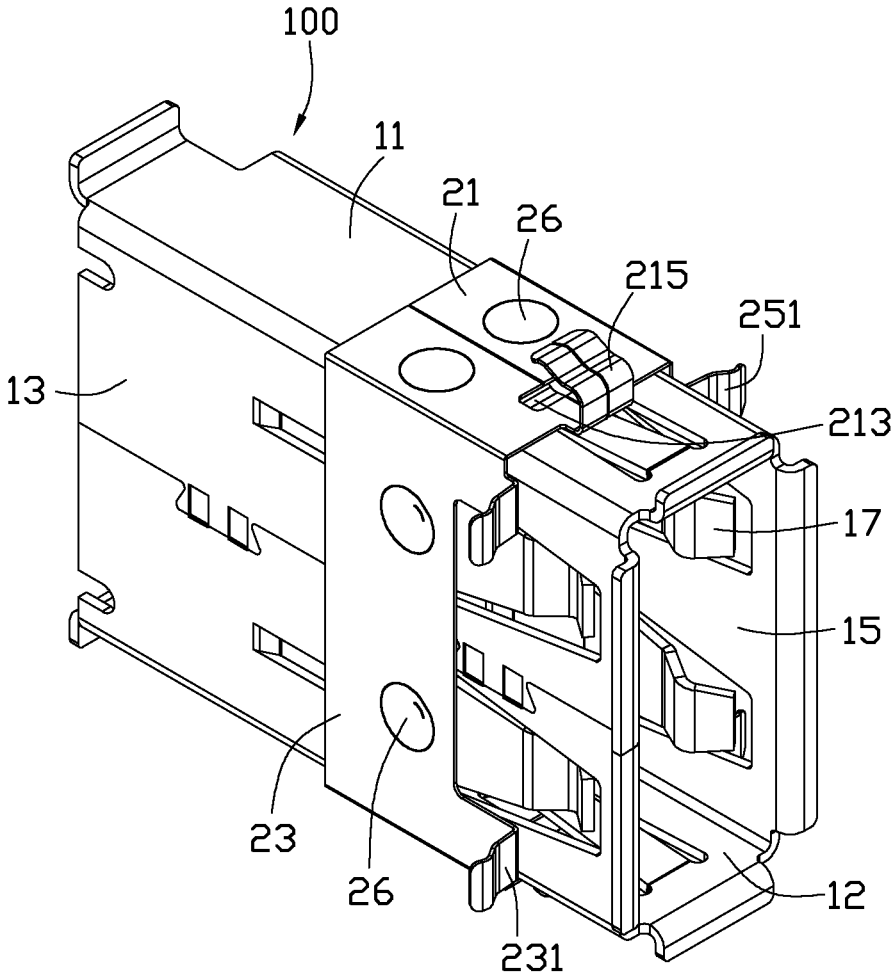
FIG. 2 is an assembled, isometric view of the USB connector of FIG. 1.
Figure 3:
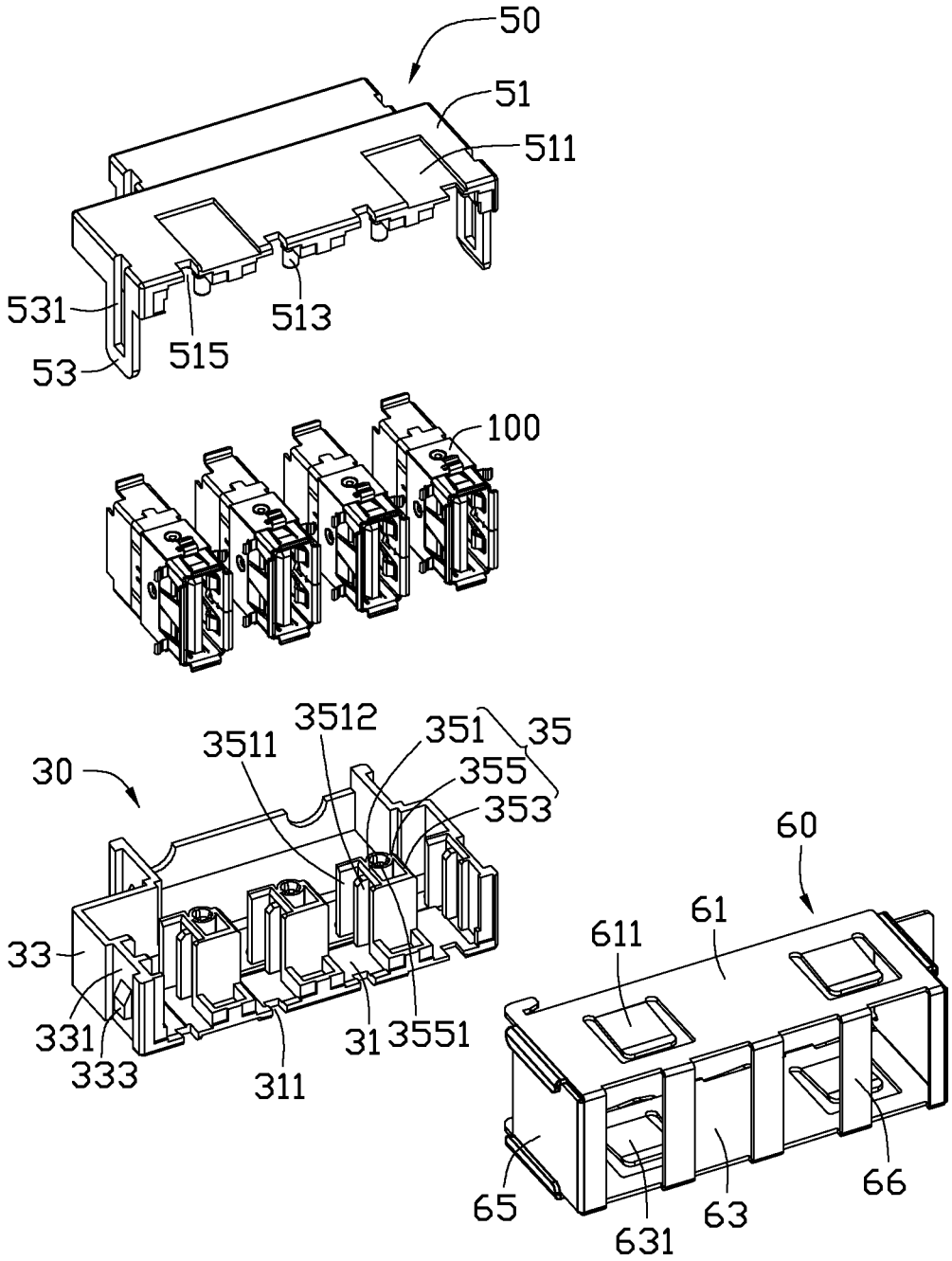
FIG. 3 is an exploded, isometric view of one embodiment of a connecting device with the USB connector of FIG. 1.
Figure 4:
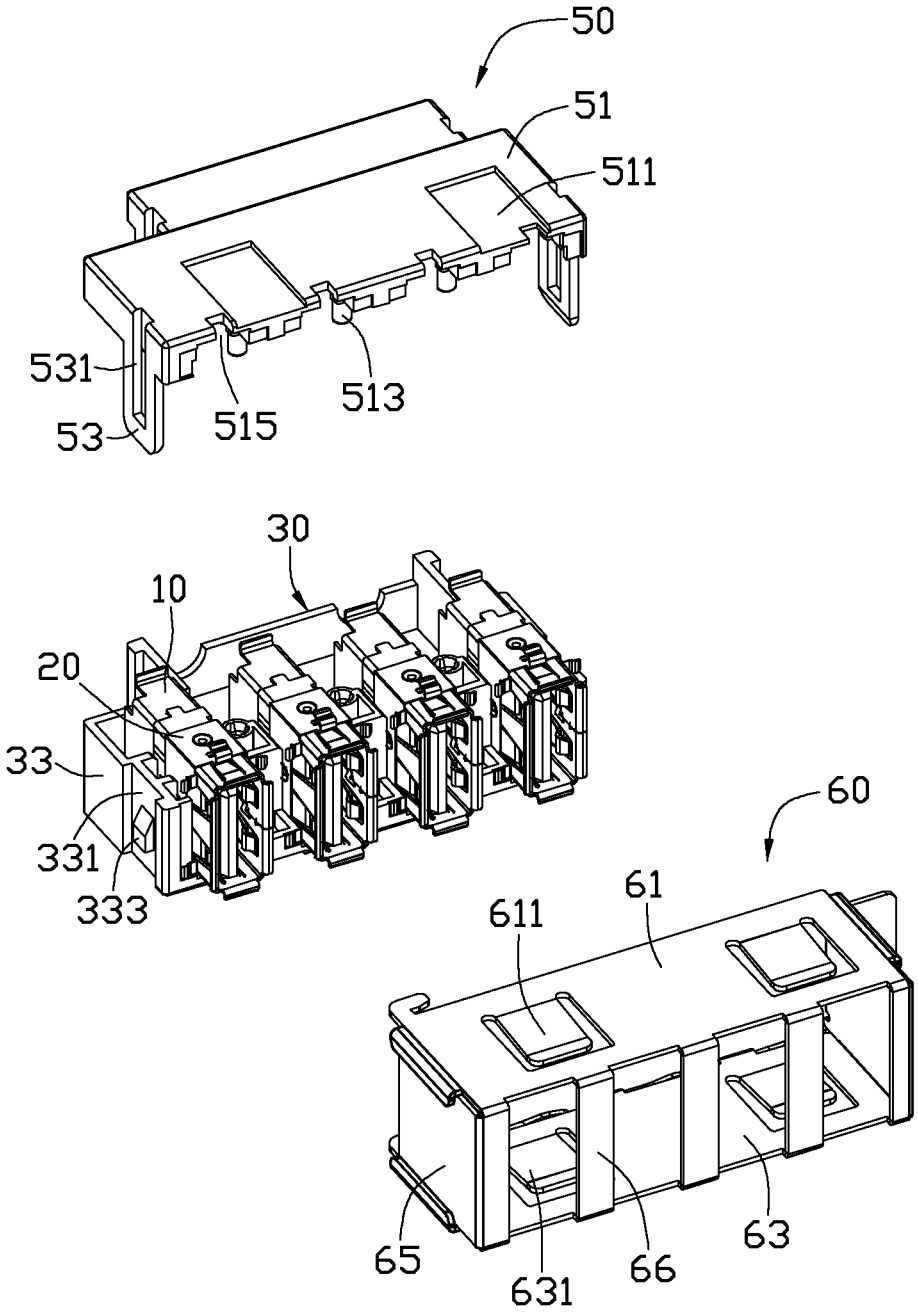
FIG. 4 is an isometric view of the connecting device with the USB connector of FIG. 3 partially assembled.
Figure 5:
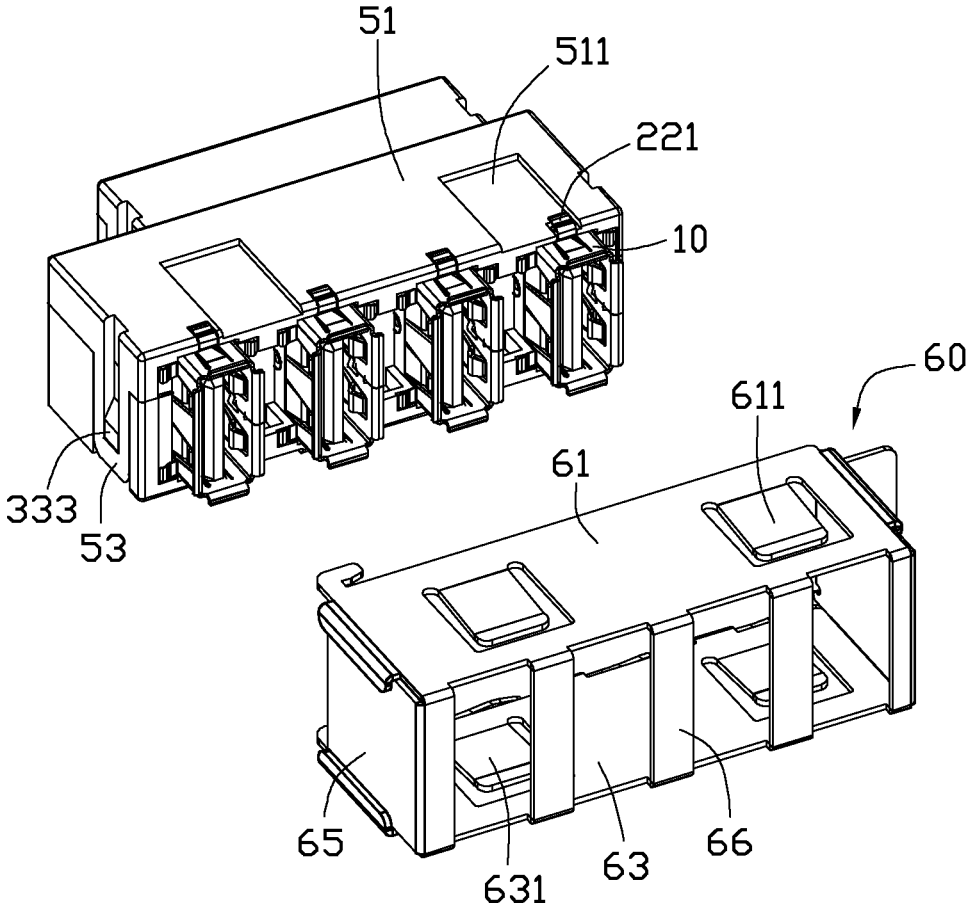
FIG. 5 is an isometric view of the connecting device with the USB connector of FIG. 4 partially assembled.
Figure 6:
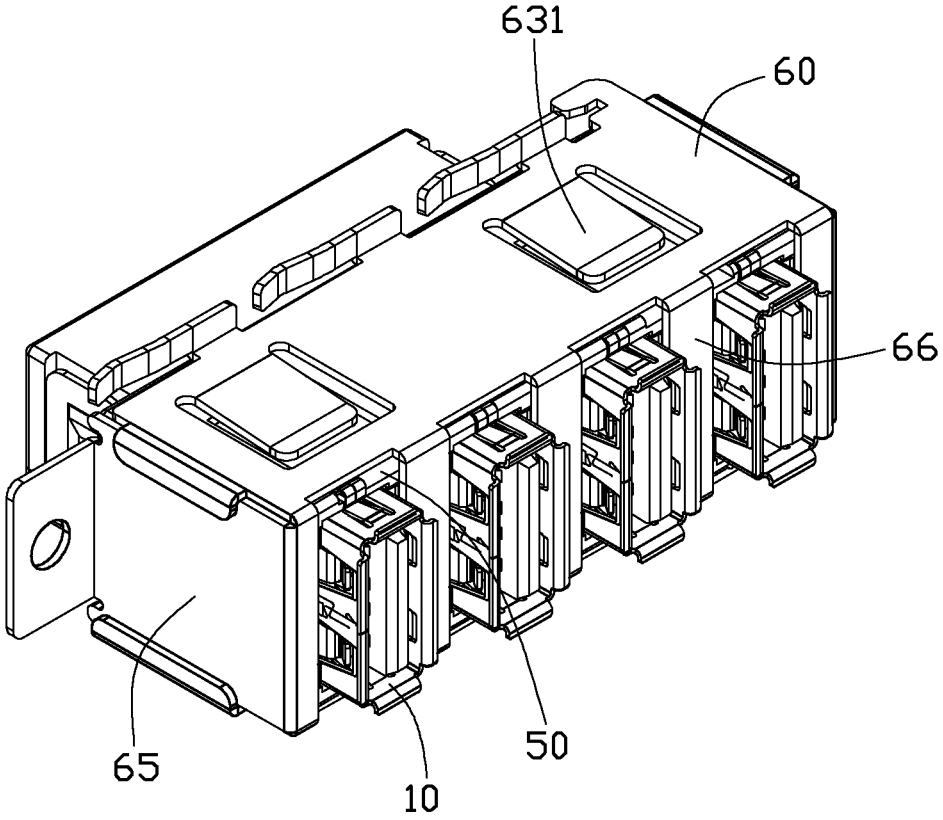
FIG. 6 is an assembled, isometric view of the connecting device with the USB connector of FIG. 3.

Referring to FIG. 2, in assembly of one of the plurality of USB connectors 100, the shelter 20 is moved towards the body 10. The front plate 23 and the rear plate 25 are driven to extend away from each other and extend the gap between the first plate 211 and the second plate 212. The shelter 20 is moved to surround the body 10. Each of the extrusion 26 is elastically deformed until each of the extrusion 26 is aligned with each of the installation hole 16. Each of the extrusion 26 rebounds to engage in each of the installation hole 16. Thus, the shelter 20 is secured to the body 10.

Referring to FIGS. 3-6, a connecting device includes a mounting assembly (not labeled), and the plurality of the USB connectors 100 secured to the mounting assembly. The mounting assembly includes a base 30, a covering member 50, and a protecting member 60.

The base 30 includes a base plate 31, and two side plates 33 extending from two opposite sides of the base plate 31. In one embodiment, the base plate 31 is substantially perpendicular to the two side plates 33. A plurality of installation portions 35 is located on the base plate 31. The base plate 31 defines a plurality of cutouts 311. Each of the installation portions 35 includes an installation piece 351, a limiting piece 353, and an installation post 355. The installation post 355 is located between the installation piece 351 and the limiting piece 353. In one embodiment, the limiting piece 353 is substantially parallel to the installation piece 351. A first positioning piece 3511 and second positioning piece 3512 extend from the installation piece 351. In one embodiment, each of the first positioning piece 3511 and the second positioning piece 3512 is substantially perpendicular to the installation piece 351. A width of the first positioning piece 3511 is greater than a width of the second positioning piece 3512. Each of the two side plates 33 defines a receiving slot 331. A latching block 333 extends from an inner surface of the receiving slot 331, and the latching block 333 is located in the receiving slot 331. The installation post 355 defines a receiving hole 3551.

The covering member 50 includes a cover 51 and two latching pieces 53. The two latching pieces 53 extend from two opposite ends of the cover 51. The cover 51 defines a plurality of holes 515. A top surface of the cover 51 defines two recessions 511. A plurality of positioning posts 513 protrude from a bottom surface of the cover 51 opposite to the top surface. Each of the two latching pieces 53 defines a latching hole 531.

The protecting member 60 includes a top wall 61, a bottom wall 63, and two sidewalls 65. In one embodiment, the top wall 61 is substantially parallel to the bottom wall 63, and the two sidewalls 65 are substantially parallel to each other. Two first restricting pieces 611 extend from the top wall 61. Two second restricting pieces 631 extend from the bottom wall 63. A plurality of protecting pieces 66 are connected between the top wall 61 and the bottom wall 63.

In assembly, each of the plurality of USB connectors 100 are placed between each of the two side plates 33 and one of the installation portions 35, and between adjacent two of the installation portions 35. The limiting piece 353 abuts the front plate 23. The second positioning piece 3512 abuts the rear plate 25. The first positioning piece 3511 abuts the rear panel 15. The second blocking piece 221 is received in one of the cutouts 311.

The covering member 50 is moved to above the base 30, each of the plurality of positioning posts 513 is aligned with the receiving hole 3551, and each of the two latching pieces 53 is aligned with the receiving slot 331. The covering member 50 is moved towards the base 30, each of the two latching pieces 53 is slid into the receiving slot 331 and elastically deformed by the latching block 333. Each of the positioning posts 513 is inserted into the receiving hole 3551. Each of the latching pieces 53 is slid over the latching block 333 and received in the receiving slot 331. Each of the latching pieces 53 rebounds to receive the latching block 333 in the latching hole 531. The first blocking piece 215 is received in the positioning hole 515. Thus, the covering member 50 is secured to the base 30 and prevents each of the plurality of USB connectors 100 from moving away from the base plate 31.

The protecting member 60 is moved to adjacent to the plurality of USB connectors 100. Each of the plurality of USB connectors 100 is aligned with adjacent two of the plurality of protecting pieces 66. Each of the two first restricting pieces 611 and each of the two second restricting pieces 631 are elastically deformed by the cover 51 and the base plate 31, until Each of the two first restricting pieces 611 is aligned with each of the two recessions 511 and each of the plurality of USB connectors 100 is partially exposed out of the adjacent two of the plurality of protecting pieces 66. Each of the two first restricting pieces 611 exerts an elastic force to the cover 51. Each of the two second restricting pieces 631 exerts an elastic force to the base plate 31. Each of the third blocking pieces 231 and the fourth blocking piece 251 abuts an inner surface of each of the protecting pieces 66. The first blocking piece 215, the second blocking piece 221, the third blocking piece 231, and the fourth blocking piece 251 prevent the connecting device from EMI.

It is to be understood, however, that even though numerous characteristics and advantages of the embodiments have been set forth in the foregoing description, together with details of the structure and function of the embodiments, the disclosure is illustrative only, and changes may be made in detail, especially in the matters of shape, size, and arrangement of parts within the principles of the invention to the full extent indicated by the broad general meaning of the terms in which the appended claims are expressed.

What is claimed is:

1. A connecting device comprising:

a protecting member;

a base;

a covering member secured to the base and covering the base; and the covering member and the base being received and mounted in the protecting member; and a USB connector mounted in the base, the USB connector comprising a body and a shelter surrounding the body; the shelter comprising a plurality of blocking pieces, each of the plurality of blocking pieces abutting the protecting member to prevent electromagnetic interference (EMI) from the body.

2. The connecting device of claim 1, wherein the shelter comprises an extrusion, the body defines an installation hole, and the extrusion is engaged in the installation hole.

3. The connecting device of claim 1, wherein the shelter further comprises a top plate and a bottom plate opposite to the top plate, and the top plate comprises a first plate and a second plate; and the first plate and the second plate are configured to secure the shelter to the body by moving away relative each other.

4. The connecting device of claim 3, wherein the body comprises two elastically deformable resilient pieces, each of the top plate and the bottom plate defines a cutout, and the cutout receives each of the two elastically deformable resilient pieces when each of the two elastically deformable resilient pieces is elastically deformed.

5. The connecting device of claim 1, wherein the base comprises a base plate, a plurality of installation portions is located on the base plate, and each of the plurality of installation portions comprises an installation piece and a limiting piece; the installation piece is substantially parallel to the limiting piece; a first positioning piece and a second positioning piece extend from the installation piece, and a width of the first positioning piece is greater than a width of the second positioning piece.

6. The connecting device of claim 5, wherein the shelter is secured between the second positioning piece and the limiting piece of adjacent one of the plurality of installation portions.

7. The connecting device of claim 5, wherein the body is secured between the first positioning piece and the limiting piece of adjacent one of the plurality of installation portions.

8. The connecting device of claim 5, wherein the base further comprises two side plates extends from two opposite ends of the base plate, each of the two side plates defines a receiving slot, and a latching block is located in the receiving slot; the covering member comprises a cover and two latching pieces extending from two opposite sides of the cover; each of the two latching pieces defines a latching hole; the latching block is engaged in the latching hole, and each of the two latching pieces is received in each of the receiving slot.

9. The connecting device of claim 8, wherein the cover defines a hole, the base plate defines a cutout, and each of the plurality of blocking pieces is received in the cutout and the hole.

10. The connecting device of claim 8, wherein the protecting member comprises a top wall, a bottom wall, and a sidewall connected to the top wall and the bottom wall; a restricting piece extending from each of the top wall and the bottom wall; the restricting piece abuts each of a top surface of the cover and a bottom surface of the base plate; and a plurality of protecting pieces is connected between the top wall and the bottom wall; and each of the plurality of blocking pieces abuts each of the plurality of protecting pieces.

11. A connecting device comprising:

a protecting member;

a base comprising a base plate, a plurality of installation portions located on the base plate, and each of the plurality of installation portions comprising an installation piece and a limiting piece substantially parallel to the installation piece; a first positioning piece and a second positioning piece extending from the installation piece, and a width of the first positioning piece being greater than a width of the second positioning piece;

a plurality of USB connectors mounted in the base; and a covering member secured to the base and covering the base; and the covering member and the base being received and mounted in the protecting member;

wherein each of the plurality of USB connectors comprises a body, and a shelter surrounding the body; the shelter is secured between the second positioning piece of the installation piece and the limiting piece of an adjacent one of the plurality of installation portions, and the body is secured between the first positioning piece and the limiting piece of adjacent one of the plurality of installation portions; the shelter comprises a plurality of blocking pieces, each of the plurality of blocking pieces abuts the protecting member to prevent electromagnetic interference (EMI) from the body.

12. The connecting device of claim 11, wherein the first positioning piece is substantially parallel to the second positioning piece.

13. The connecting device of claim 11, wherein the shelter comprises an extrusion, the body defines an installation hole, and the extrusion is engaged in the installation hole.

14. The connecting device of claim 11, wherein the shelter further comprises a top plate and a bottom plate opposite to the top plate, and the top plate comprises a first plate and a second plate; and the first plate and the second plate are configured to secure the shelter to the body by moving away relative each other.

15. The connecting device of claim 14, wherein the body comprises two elastically deformable resilient pieces, each of the top plate and the bottom plate defines a cutout, and the cutout receives each of the two elastically deformable resilient pieces when each of the two elastically deformable resilient pieces is elastically deformed.

16. The connecting device of claim 11, wherein the base further comprises two side plates extends from two opposite ends of the base plate, each of the two side plates defines a receiving slot, and a latching block is located in the receiving slot; the covering member comprises a cover and two latching pieces extending from two opposite sides of the cover; each of the two latching pieces defines a latching hole; and the latching block is engaged in the latching hole.

17. The connecting device of claim 16, wherein each of the two latching pieces is received in each of the receiving slot.

18. The connecting device of claim 16, wherein the cover defines a hole, the base plate defines a cutout, and each of the blocking pieces is received in the cutout and the hole.

19. The connecting device of claim 16, wherein the protecting member comprises a top wall, a bottom wall, and a sidewall connected to the top wall and the bottom wall; a restricting piece extending from each of the top wall and the bottom wall; the restricting piece abuts each of a top surface of the cover and a bottom surface of the base plate; and a plurality of protecting pieces is connected between the top wall and the bottom wall; and each of the plurality of blocking pieces abuts each of the plurality of protecting pieces.

* * * * *